US005632248A

United States Patent [19]

Sugii

[11] Patent Number: 5,632,248

[45] Date of Patent: May 27, 1997

[54] ELECTRONICALLY CONTROLLED TYPE FLOATLESS CARBURETOR

[75] Inventor: Toshio Sugii, Odawara, Japan

[73] Assignee: Mikuni Corporation, Japan

[21] Appl. No.: 468,702

[22] Filed: Jun. 6, 1995

[51] Int. Cl.[6] ..... F02M 7/133; F02M 7/20; F02M 7/24

[52] U.S. Cl. ..... 123/438; 261/35

[58] Field of Search ..... 123/438, 701; 261/35, DIG. 68, DIG. 74

[56] References Cited

U.S. PATENT DOCUMENTS

| | | | |
|---|---|---|---|
| 4,465,048 | 8/1984 | Morozumi et al. | 123/438 |
| 4,949,692 | 8/1990 | Devine | 123/438 |
| 5,345,912 | 9/1994 | Svensson et al. | 123/438 |
| 5,465,698 | 11/1995 | Benholz | 123/438 |

FOREIGN PATENT DOCUMENTS

| | | | |
|---|---|---|---|
| 1445849 | 8/1976 | United Kingdom | 123/438 |

*Primary Examiner*—Andrew M. Dolinar
*Attorney, Agent, or Firm*—Ladas & Parry

[57] ABSTRACT

An electronically controlled type floatless carburetor includes a fuel regulating chamber from which fuel is delivered to a main fuel passage including a main jet and a pilot fuel passage including a pilot jet as a main diaphragm is actuated. A main solenoid valve is disposed at the intermediate position of the main fuel passage located on the downstream side of the main jet. In addition, a pilot solenoid valve is disposed at the intermediate position of the pilot fuel passage located on the downstream side of the pilot jet. Operation of each of the main solenoid valve and the pilot solenoid valve is controlled by an electronic controlling circuit into which various parameters are inputted so as to assure that main fuel and pilot fuel are ejected in a suction passage from a main nozzle and a slow system ejection port while they are well adapted to all operational states of an engine.

15 Claims, 8 Drawing Sheets

36
ENGINE SPEED SENSOR
37
ATMOSPHERIC PRESSURE SENSOR
38
THROTTLE VALVE ORENING EXTENT SENSOR
39
SUCTION PASSAGE NEGATIVE PRESSURE SENSOR
61
ENGINE COOLANT TEMPERATURE SENSOR
62
TEMPERATURE SENSOR
35
ELECTRONIC CONTROLLING CIRCUIT
CRANK CHAMBER
15
FUEL TANK
7

ELECTRONIC
CONTROLLING
CIRCUIT
35
43

3
21
40
44
42
23
22
28
27
29
41
20
2
4

ELECTRONIC
CONTROLLING
CIRCUIT
35

32
45
AIR
CLEANER
34
3
23
21
46
22
47
28
27
29
2
20
4

ELECTRONIC
CONTROLLING
CIRCUIT
35

43
45
AIR
CLEANER
48
3
21
23
40
44
41
22
28
27
29
20
2
4

ELECTRONICALLY CONTROLLED TYPE FLOATLESS CARBURETOR

BACKGROUND OF THE INVENTION

1. Field of the Invention

The present invention relates generally to a floatless carburetor including no float chamber and adapted to eject fuel in a suction passage by actuation of a diaphragm. More particularly, the present invention relates to an electronically controlled type floatless carburetor which assures that an adequate air fuel ratio can be obtained within any operational range of an engine.

2. Description of the Prior Art

A floatless carburetor including no float chamber and adapted to eject main fuel and slow system fuel to be described later in a suction passage has been hitherto known. The floatless carburetor is typically constructed such that one wall surface of a fuel regulating chamber is formed by a diaphragm, negative pressure of the suction passage is exerted on the diaphragm via the fuel regulating chamber, and fuel from the fuel regulating chamber is ejected in the suction passage via a main nozzle, a bypass hole and a pilot outlet. Since the floatless carburetor does not include any float chamber, it has an advantage that it can be adapted to any inclined state thereof.

Since the floatless carburetor has a simple structure for ejecting fuel therefrom, an operational range of the engine where an adequate air fuel ratio can be obtained is limitativaly determined. For this reason, the floatless carburetor is used while making a compromise with the fact that an adequate quantity of fuel is not always ejected in various engine operational range as well as in various load range, resulting in an adequate air fuel ratio failing to be obtained.

When the floatless carburetor is used on a ground having a high altitude, since the air fuel ratio is excessively increased with specifications designed for a ground having a low altitude, a measure is taken such that jets and others, i.e., interior components of the carburetor are exchanged with another ones. However, a problem is that many manhours are required for achieving the exchanging operation.

SUMMARY OF THE INVENTION

The present invention has been made in consideration of the aforementioned background.

An object of the present invention is to provide an electronically controlled type floatless carburetor which assures that an adequate air fuel ratio can be obtained over the whole operational range of an engine, and moreover, makes it possible to maintain excellent properties of operation.

According to a first aspect of the present invention, there is provided an electronically controlled type floatless carburetor wherein fuel is delivered to a fuel regulating chamber by actuation of pumping means, the fuel from the fuel regulating chamber is ejected in a suction passage from a main nozzle via a main fuel passage including a main jet, and moreover, the fuel from the fuel regulating member is ejected in the suction passage from a slow system ejection port via a pilot fuel passage including a pilot jet, wherein the carburetor comprises a main bypass passage by way of which the position located on the upstream side of the main jet of the main fuel passage is communicated with the position located on the downstream side of the same, a main solenoid valve disposed at the intermediate position of the main bypass passage to adjust a quantity of fuel passing through the main bypass passage by duty driving, and an electronic controlling circuit for controlling actuation of the main solenoid valve in response to inputting of one or more parameter, whereby a quantity of fuel is ejected in the suction passage, the quantity being such that a quantity of fuel adjusted by duty driving while passing through the main bypass passage as the main solenoid valve is actuated and a quantity of fuel passing through the main jet are summed up. With this construction, since a variable quantity of fuel passing through the main bypass passage is added to a stationary quantity of fuel passing through the main jet, an adequate air fuel ratio can be obtained by feeding an adequate quantity of main fuel over the whole operational range of the engine.

According to a second aspect of the present invention, there is provided an electronically controlled type floatless carburetor wherein fuel is delivered to a fuel regulating chamber by actuation of pumping means, the fuel from the fuel regulating chamber is ejected in a suction passage from a main nozzle via a main fuel passage including a main nozzle, and moreover, the fuel from the fuel regulating chamber is ejected in the suction passage from a slow system port via a pilot fuel passage including a pilot jet, wherein the carburetor comprises a pilot bypass passage by way of which the position located on the upstream side of the pilot jet is communicated with the position located on the downstream side of the same, a pilot solenoid valve disposed on the intermediate position of the pilot bypass passage to adjust a quantity of fuel passing through the pilot bypass passage by duty driving, and an electronic controlling circuit for controlling actuation of the pilot solenoid valve, in response to inputting of one or more parameter, whereby a quantity of fuel is ejected in the suction passage, the quantity being such that a quantity of fuel adjusted by duty driving while passing through the pilot bypass passage as the pilot solenoid valve is actuated and a quantity of fuel passing through the pilot jet are summed up. With this construction, since a variable quantity of fuel passing through the pilot bypass passage is added to a stationary quantity of fuel passing through the pilot jet, an adequate air fuel ratio can be obtained by feeding an adequate quantity of pilot fuel over the whole operational range of the engine.

According to a third aspect of the present invention, there is provided an electronically controlled type floatless carburetor wherein fuel is delivered to a fuel regulating chamber by actuation of pumping means, the fuel from the fuel regulating chamber is ejected in a suction passage from a main nozzle via a main fuel passage including a main jet, and moreover, the fuel from the fuel regulating chamber is ejected in the suction passage from a slow system ejection port via a pilot fuel passage including a pilot jet, wherein the carburetor comprises a main bypass passage of which one end is communicated with the main fuel passage located downstream of the main jet, a pilot bypass passage of which one end is communicated with the pilot fuel passage located downstream of the pilot jet, the other end of the main bypass passage and the other end of the pilot bypass passage being united with each other to form a fuel introduction passage of which other end is communicated with the fuel regulating chamber, a solenoid valve disposed at the intermediate position of the fuel introduction passage to adjust a quantity of fuel passing through the fuel introduction passage by duty driving, and an electronic controlling circuit for controlling actuation of the solenoid valve in response to inputting of one or more parameter, whereby a quantity of fuel is ejected in the suction passage, the quantity being such that a quantity of fuel adjusted by duty driving while passing through the main bypass passage as the solenoid is actuated and a quantity of fuel passing through the main jet are summed up, and moreover, another quantity of fuel is ejected in the suction passage through the slow system ejection port, the another quantity being such that a quantity of fuel adjusted by duty driving while passing through the pilot bypass passage and a quantity of fuel passing through the pilot jet are summed up. With this construction, since a variable quantity of fuel passing through the main bypass passage is added to a stationary quantity of fuel passing through the main jet, and moreover, a variable quantity of fuel passing through the pilot bypass passage is added to a stationary quantity of fuel passing through the pilot jet, an adequate air fuel ratio can be obtained by feeding an adequate quantity of fuel over the whole operational range of the engine.

According to a fourth aspect of the present invention, there is provided an electronically controlled type floatless carburetor wherein fuel is delivered to a fuel regulating chamber by actuation of pumping means, the fuel from the fuel regulating chamber is ejected in a suction passage from a main nozzle via a main fuel passage including a main jet, and moreover, the fuel from the fuel regulating chamber is ejected in the suction passage from a slow system ejection port via a pilot fuel passage including a pilot jet, wherein the carburetor comprises a main air passage of which one end is communicated with atmosphere and of which other end is communicated with the main fuel passage at the position located downstream of the main jet, a main solenoid valve disposed at the intermediate position of the main air passage to adjust a quantity of air passing through the main air passage by duty driving, and an electronic controlling circuit for controlling actuation of the main solenoid valve in response to inputting of one or more parameter, whereby a quantity of liquid is ejected in the suction passage from the main nozzle, the quantity being such that a quantity of air adjusted by duty driving while passing through the main air passage as the main solenoid valve is actuated and a quantity of fuel passing through the main jet are summed up. With this construction, since a variable quantity of air passing through the main bypass passage is added to a stationary quantity of fuel passing through the main jet, an adequate air fuel ratio can be obtained by feeding main fuel over the whole operational range of the engine.

According to a fifth aspect of the present invention, there is provided an electronically controlled type floatless carburetor wherein fuel is delivered to a fuel regulating chamber by actuation of pumping means, the fuel from the fuel regulating chamber is ejected in a suction passage from a main nozzle via a main fuel passage including a main jet, and moreover, the fuel from the fuel regulating chamber is ejected in the suction passage from a slow system ejection port via a pilot fuel passage including a pilot jet, wherein the carburetor comprises a pilot air passage of which one end is communicated with atmosphere and of which other end is communicated with the pilot fuel passage located downstream of the pilot jet, a pilot solenoid valve disposed at the intermediate position of the pilot air passage to adjust a quantity of air passing through the pilot air passage by duty driving, and an electronic controlling circuit for controlling actuation of the pilot solenoid valve in response to inputting of one or more parameter, whereby a quantity of fluid is ejected in the suction passage from the slow system ejection port, the quantity being such that a quantity of air adjusted by duty driving while passing through the pilot air passage as the pilot solenoid valve-is actuated and a quantity of fuel passing through the pilot jet is summed up. With this construction, since a variable quantity of air passing through the main pilot passage is added to a stationary quantity of fuel passing through the pilot jet, an adequate air fuel ratio can be obtained by feeding an adequate quantity of pilot fuel over the whole operational range of the engine.

According to a sixth aspect of the present invention, there is provided an electronically controlled type floatless carburetor wherein fuel is delivered to a fuel regulating chamber by actuation of pumping means, the fuel from the fuel regulating chamber is ejected in a suction passage from a main nozzle via a main fuel passage including a main jet, and moreover, the fuel from the fuel regulating chamber is ejected in the suction passage from a slow system ejection port via a pilot fuel passage including a pilot jet, wherein the carburetor comprises a main bypass passage of which one end is communicated with the main fuel passage at the position located downstream of the main jet, a pilot bypass passage of which one end is communicated with the pilot fuel passage at the position located downstream of the pilot jet, the other end of the main bypass passage being united with the other end of the pilot bypass passage to form an air introduction passage of which other end is communicated with atmosphere, a solenoid valve disposed at the intermediate position of the air introduction passage to adjust a quantity of air passing the air introduction passage by duty driving, and an electric controlling circuit for controlling actuation of the solenoid valve in response to inputting of one or more parameter, whereby a quantity of fluid is ejected in the suction passage from the main nozzle, the quantity being such that a quantity of air adjusted by duty driving while passing through the main bypass passage and a quantity of fuel passing through the main jet are summed up, and moreover, another quantity of fluid is ejected in the suction passage from the slow system ejection port, the another quantity being such that a quantity of air adjusted by duty driving while passing through the pilot bypass passage and a quantity of fuel passing through the pilot jet are summed up. With this construction, since a variable quantity of air passing through the main bypass passage is added to a stationary quantity of fuel passing through the main jet, and moreover, a variable quantity of air passing through the main pilot passage is added to a stationary quantity of fuel passing through the pilot jet, an adequate air fuel ratio can be obtained by feeding an adequate quantity of fuel over the whole operational range of the engine.

According to a seventh aspect of the present invention, there is provided an electronically controlled type floatless carburetor wherein fuel is delivered to a fuel regulating chamber by actuation of pumping means, the fuel from the fuel regulating chamber is ejected in a suction passage from a main nozzle via a main fuel passage including a main jet, and moreover, the fuel from the fuel regulating chamber is ejected in the suction passage from a slow system ejection port via a pilot fuel passage including a pilot jet, wherein the carburetor comprises a united fuel passage having the main fuel passage and the pilot fuel passage united with each other, a fuel communication passage for communicating the united fuel passage with the fuel regulating passage via a throttle, a solenoid valve disposed at the intermediate position of the fuel communication passage to adjust a quantity of fuel passing through the fuel communication passage by duty driving, and an electronic controlling circuit for controlling actuation of the solenoid valve in response to inputting of one or more parameter, whereby a quantity of fuel is delivered to the main fuel passage and the pilot fuel passage, the quantity being such that a quantity of fuel adjusted by the duty driving while passing through the fuel communication passage as the solenoid valve is actuated and a quantity of fuel flowing through the throttle are summed up. With this construction, since a variable quantity of fuel passing through the throttle is added to a stationary quantity of fuel passing through the fuel communication passage, an adequate air fuel ratio can be obtained by feeding an adequate quantity of fuel over the whole operational range of the engine.

According to an eighth aspect of the present invention, there is provided an electronically controlled type floatless carburetor wherein a throttle valve is disposed at the intermediate position of a suction path, fuel is delivered to a fuel regulating chamber via a starting well by actuation of pumping means, and moreover, the fuel from the fuel regulating chamber is ejected in the suction passage from a main nozzle via a main fuel passage including a main jet, wherein the carburetor comprises a solenoid valve disposed at the position located upstream of the throttle valve in the suction passage to eject therefrom a quantity of fuel adjusted by duty driving, a fuel communication passage by way of which the starting well and the solenoid valve are communicated with each other, and an electronic controlling circuit for controlling actuation of the solenoid valve in response to inputting of one or more parameter, whereby a quantity of fuel adjusted by duty driving is ejected upstream of the throttle valve in the suction passage as the solenoid valve is actuated. With this construction, since a variable quantity of fuel is ejected directly in the suction passage, an adequate air fuel ratio can be obtained by feeding an adequate quantity of fuel over the whole operational range of the engine.

Finally, according to a ninth aspect of the present invention, there is provided an electronically controlled type floatless carburetor wherein a throttle valve is disposed at the intermediate position of a suction passage, fuel is delivered to a fuel regulating chamber including a main diaphragm as a wall surface, by actuation of pumping means, the fuel from the fuel regulating chamber is ejected in the suction passage from a main nozzle via a main fuel passage including a main jet, and moreover, the fuel from the fuel regulating chamber is ejected in the suction passage from a slow system ejection port via a pilot fuel passage including a pilot jet, wherein the carburetor comprises a negative pressure introduction chamber formed on the opposite side to the fuel regulating chamber with the main diaphragm disposed at the central position therebetween, the negative pressure introduction chamber being communicated with the suction passage via a negative pressure introduction passage, an atmosphere passage disposed at the intermediate position of the negative pressure introduction passage to be communicated with atmosphere, a throttle disposed at the intermediate position of the atmosphere passage, a solenoid valve disposed at the intermediate position of the negative pressure introduction passage on the suction passage side located away from the communication position with the atmosphere passage, and an electronic controlling circuit for controlling actuation of the solenoid valve in response to inputting of one or more parameter, whereby a quantity of negative pressure air adjusted by duty driving is introduced into the negative pressure chamber as the solenoid valve is actuated. With this construction, since the negative pressure introduction chamber is formed on the opposite side to the fuel regulating chamber so that a quantity of fuel to be fed to the fuel regulating chamber is adjusted by introducing negative pressure into the negative pressure introduction chamber, an adequate air fuel ratio can be obtained by feeding an adequate quantity of fuel over the whole operational range of the engine.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate several preferred embodiments thereof.

Figure 1:
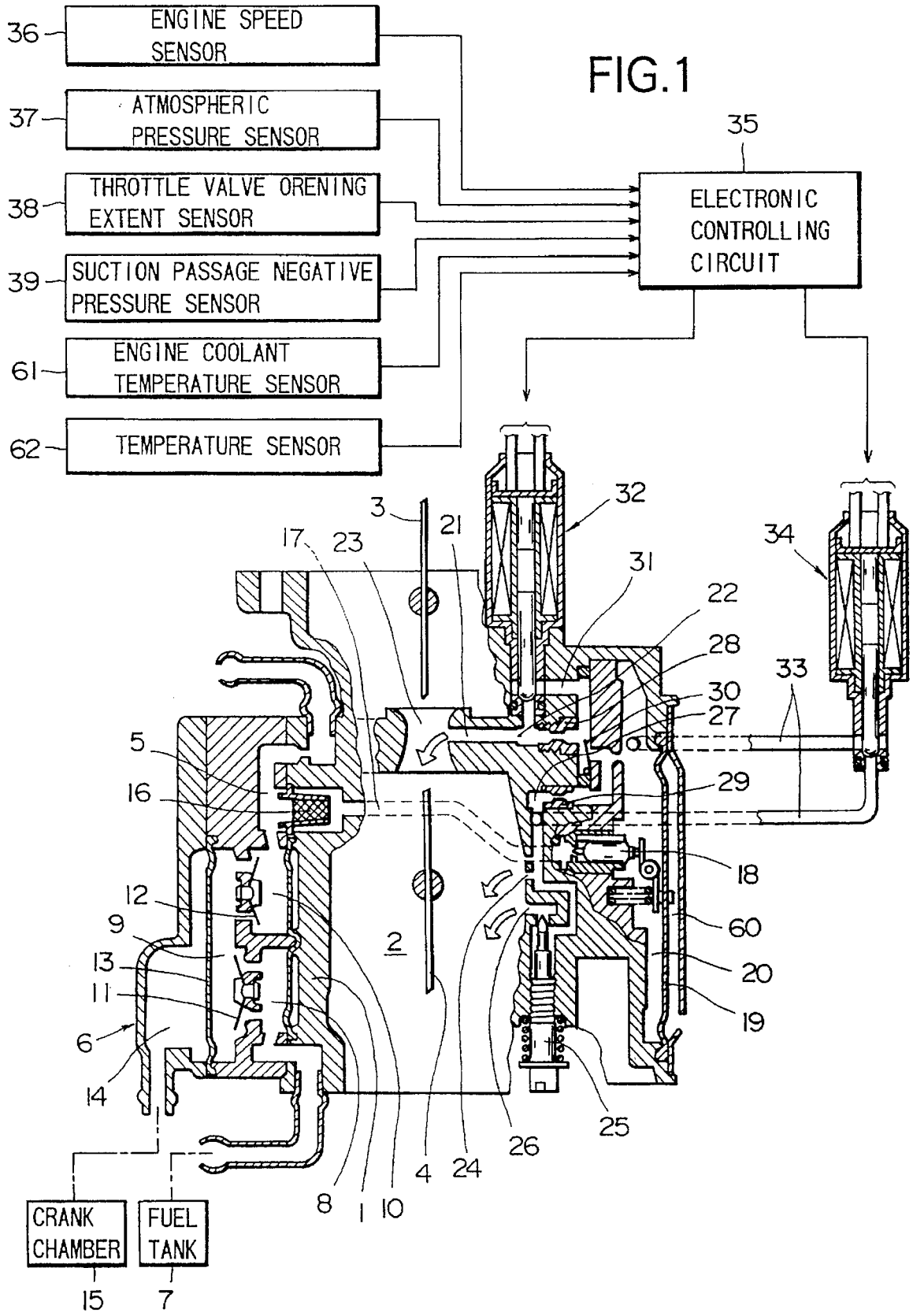
FIG. 1 is a sectional view which which schematically shows the structure of a electronically controlled type floatless carburetor constructed in accordance with a first embodiment of the present invention.

FIG. 1 is a sectional view which schematically show the structure of an electronically controlled type floatless carburetor constructed in accordance with a first embodiment of the present invention. The carburetor includes a casing 1 in which a suction passage 2 is formed, and a choke valve 3 and a throttle valve are turnably disposed at the intermediate positions in the suction passage 2. To feed fuel to a fuel feeding chamber 5, the casing 1 is equipped with a pumping unit 6.

The pumping unit 6 includes a first fuel introduction chamber 8 to which fuel is normally fed from a fuel tank 7, a pumping chamber 9 communicated with the first fuel introduction chamber 8, and a second fuel introduction chamber 10 communicated not only with the pumping chamber 9 but also with the fuel feeding chamber 5. In addition, an inlet check valve 11 for displacing fuel from the first fuel introduction chamber 8 only to the pumping chamber 9 is disposed between the first fuel introduction chamber 8 and the pumping chamber 9. Further, an outlet check valve 12 for displacing fuel from the pumping chamber 9 only to the second fuel introduction chamber 10 is disposed between the pumping chamber 9 and the second fuel introduction chamber 10.

One wall surface of the pumping chamber 9 is formed by a diaphragm 13, and a pulse chamber 14 is disposed on the opposite side relative to the pumping chamber 9 with the diaphragm 13 located therebetween. For example, pressure in a crank chamber 15 of an engine (alternating pressure varying between positive pressure and negative pressure) is introduced into the pulse chamber 14. As pressure from the crank chamber 15 is introduced into the pulse chamber 14 in that way, fuel is introduced into the second fuel introduction chamber 10 from the first fuel introduction chamber 8 via the pumping chamber 9, and subsequently, fuel is delivered from the second fuel introduction chamber 10 to a fuel feeding chamber 5 communicated with the second fuel introduction chamber 10. In such manner, the pumping unit 6 serves to deliver fuel to the fuel feeding chamber 5, and the structure of the pumping unit 6 should not be limited only to the aforementioned one but any type of pumping unit is acceptable, provided that it can reliably deliver fuel to the fuel feeding chamber 5.

As fuel is introduced into the fuel feeding chamber 5 by the pumping unit 6, it is first filtered and then introduced into a starting well 17. The fuel in the starting well 17 is introduced via an inlet needle 18 into a fuel regulating chamber 20, of which one wall surface is formed by a main diaphragm 19, as it is pumped by the pumping unit 6. An atmosphere chamber 60 located on the opposite side relative to the fuel regulating chamber 20 with the main diaphragm 19 disposed therebetween is communicated with atmosphere.

The fuel regulating chamber 20 is communicated with a main fuel passage 22 leading to a main nozzle 21, and the main nozzle 21 is exposed to a Venturi portion 23 of the suction passage 2. The fuel regulating chamber 20 is communicated with a pilot fuel passage 27 which leads to a pilot outlet 26 of which flowing capacity is adjusted by a bypass hole 24 and a pilot screw 25, and the bypass hole 24 and the pilot outlet 26 are exposed to the suction passage 2 at the positions facing to the positions to be occupied by the turnable throttle valve 3. A combination of the bypass hole 24 with the pilot outlet 26 is hereinafter referred to as "a slow system ejection port".

Fuel in the fuel regulating chamber 20 is ejected to the suction passage 2 via the main nozzle 21 and the slow system ejection port, and fuel is introduced into the fuel regulating chamber 20 from the inlet needle 18 while balance is established among the pressure in the fuel regulating chamber 20 having a quantity of fuel held therein reduced, the pressure of the fuel delivered from the pumping unit 6 to the inlet needle 18 and the pressure in the atmosphere chamber 60.

A main jet 28 is disposed at the intermediate position of the main fuel passage 22, and moreover, a pilot jet 29 is disposed at the intermediate position of the pilot fuel passage 27. In addition, a check valve 30 is disposed in the main fuel passage 22 on the fuel regulating chamber 20 side so as to prevent back flow of air from the main fuel passage 22 to the fuel regulating chamber 20 and the pilot fuel passage 27.

A main bypass passage 31 is formed at the intermediate position of the main fuel passage 22 so as to allow the upstream side of the main jet 28 to be communicated with the downstream side of the same. A main solenoid valve 32 for adjusting a quantity of fuel passing therethrough is disposed at the intermediate position of the main bypass passage 31. The check valve 30 serves to prevent back flow of air from both of the main fuel passage 22 and the main bypass passage 31. The upstream side of the main bypass passage 31 may be connected to the fuel regulating chamber 20 but not to the main fuel passage 22. In this case, another check valve different from the check valve 30 is disposed at the intermediate position on the upstream side of the main bypass passage 31.

On the other hand, a pilot bypass passage 33 is formed between the upstream side of the pilot jet 29 in the pilot fuel passage 27 and the downstream side of the same. As shown in FIG. 1, it is acceptable that the upstream side of the pilot bypass passage 33 is communicated with the fuel regulating chamber 20. A pilot solenoid valve 34 for adjusting a quantity of fuel passing therethrough is disposed at the intermediate position of the pilot bypass passage 33.

The main solenoid valve 32 and the pilot solenoid valve 34 are independently controlled by an electronic controlling circuit 35. Various parameter signals outputted from, e.g, an engine speed sensor 36 for detecting an engine speed, an atmospheric pressure sensor 37 for detecting atmospheric pressure, a valve opening extent sensor 38 for detecting an extent of opening of the throttle valve 4, a negative pressure sensor 39 for detecting negative pressure in the suction passage 2, a coolant temperature sensor 61 for detecting temperature of coolant in the engine, and a temperature sensor 62 for detecting intake air temperature are inputted into the electronic controlling circuit 35 which in turn make calculations based on these parameters so as to actuate the main solenoid valve 32 and the pilot solenoid valve 34. It is sufficient that at least one or more parameter is inputted into the electronic controlling circuit 35. It is desirable that among the aforementioned parameters, parameters representing the atmospheric pressure associated with an altitude, the extent of opening of the throttle valve, the negative pressure in the suction passage, the temperature of coolant in the engine, and the temperature of intake air at a staring time or at a warming-up time are combined with each other based on the engine speed.

To assure that an optimum air fuel ratio is obtained, a quantity of fuel passing through the main bypass passage 31 and a quantity of fuel passing through the pilot bypass passage 33 are preliminary memorized in the electronic controlling circuit 35 in consideration of the optimum driving state of the main solenoid valve 32 and the pilot solenoid valve 34. Consequently, depending on the operative state of the engine, there arises an occasion that both of the main solenoid valve 32 and the pilot solenoid valve 34 are actuated, there arises an occasion that only one of them is actuated and there arises an occasion that both of them are not actuated.

Opening and closing operations of the main solenoid valve 32 and the pilot solenoid valve 34 to be performed with the aid of the electronic controlling circuit 35 involve the valve opened state and the valve closed state of each passage per one pulse while, e.g., a period is kept fixed. A valve opening rate and a valve closing rate of the main solenoid valve 32 and the pilot solenoid valve 34 are controlled by the electronic controlling circuit 35 (such control is hereinafter referred to as "duty control").

Incidentally, it is not necessary that opening and closing operations of the main solenoid valves 32 and the pilot solenoid valve 34 are performed with a fixed period. It is acceptable that they are actuated in conformity with the period synchronized with, e.g., an engine speed. In addition, the main solenoid valve 32 and the pilot solenoid valve 34 are normally actuated in conformity with a fixed period. However, it is acceptable that the main solenoid valve 32 and the pilot solenoid valve 34 are actuated in conformity with the period synchronized with a specific engine speed. In such a manner, it is possible to actuate the main solenoid valve 32 and the pilot solenoid valve 34 either with a fixed period or with a variable period. It is acceptable that a solenoid valve 43 to be described later is actuated either with a fixed period or a variable period.

Here, it is assumed that such a rate that the main solenoid valve 32 is actuated and the main bypass passage 31 is opened for a time of one period is hereinafter referred to as "a duty rate". In the case that the duty ratio is 0%, the main bypass passage 31 is kept closed and no fuel passes through the main bypass passage 31. On the other hand, when the main solenoid valve 32 receives duty control and the duty ratio does not become 0%, fuel passes through the main bypass passage 31. A quantity of fuel passing through the main bypass passage 31 increases as the duty ratio is enlarged more and more, whereby a quantity of main fuel to be fed to the main nozzle 21 from the main fuel passage 22 increases. The pilot solenoid valve 34 and the solenoid valve 43 (to be described later) are operated in the same manner as the main solenoid valve 32.

Next, a mode of operation of the electronically controlled type floatless carburetor constructed in the aforementioned manner will be described below.

When signals representing various parameter such as an engine speed or the like are inputted into the electronic controlling circuit 35, the main solenoid valve 32 and the pilot solenoid valve 34 independently receive duty control depending on the operative state of the engine.

When the main solenoid valve 32 is actuated, fuel of which quantity of adjusted by the main solenoid valve 32 is fed from the main bypass passage 31 to the main fuel passage 22 on the downstream side of the main jet 28. Consequently, a quantity of fuel passing through the main jet 28 serving as a fixed jet and a quantity of fuel measured at the main solenoid valve 32 serving as a variable jet are summed up, and the resultant quantity of fuel is ejected to the Venturi portion 23 through the main nozzle 21 as main fuel.

When the pilot solenoid valve 34 is actuated, fuel of which quantity is adjusted by the pilot solenoid valve 34 is fed from the pilot bypass passage 33 to the pilot fuel passage 27 on the downstream side of the pilot valve 29. Consequently, a quantity of fuel passing through the pilot jet 29 serving as a fixed jet and a quantity of fuel measured at the pilot solenoid valve 34 serving as a variable jet are summed up, and the resultant quantity of fuel is ejected to the suction passage 2 through the pilot outlet 30 as slow system fuel.

As described above, with respect to the electronically controlled type floatless carburetor of the present invention, an adequate air fuel ratio can be obtained within the whole operational range of the engine without surplus and shortage in a quantity of fuel conventionally arising within the specific operational range by variably controlling a quantity of feed of auxiliary fuel with the aid of the main solenoid valve 32 and the pilot solenoid valve 34. Thus, excellent properties of operation of the engine can be maintained at all times.

In this embodiment, description has been made with respect to the case that the main solenoid valve 32 and the pilot solenoid valve 34 are simultaneously used to obtain an adequate air fuel ratio. In the case that the range requiring that the air fuel ratio is optimized is associated with main fuel, it is acceptable that only the main solenoid valve 32 is used while the pilot solenoid valve 34 is not used. On the contrary, in the case that the range requiring that the air fuel ratio is optimized is associated with pilot fuel, it is acceptable that only the pilot solenoid valve 34 is used while the main solenoid valve 32 is not used.

Generally, with respect to a conventional carburetor, since the main diaphragm 19 serving as a wall surface of the fuel regulating chamber 20 faces to the atmospheric chamber 60, a quantity of ejection of fuel from the fuel regulating chamber 20 to the suction passage 2 varies depending on an altitude, resulting in an adequate air fuel ratio failing to be obtained. However, with respect to the electronically controlled type floatless carburetor of the present invention, when a measure is taken such that a signal outputted from the atmospheric pressure sensor 37 is inputted into the electronic controlling circuit 35, the air fuel ratio can automatically be optimized by variably controlling the ejection of auxiliary fuel from the main solenoid valve 32 and the pilot solenoid valve 34 in response to variation of the atmospheric pressure. In addition, when a measure is taken such that signals outputted from the throttle valve opening extent sensor 38, the suction passage negative pressure sensor 39 and the engine coolant temperature sensor 61 are inputted into the electronic controlling circuit 35, a stable engine speed can be obtained at a starting time or at a warming-up time by variably controlling the ejection of auxiliary fuel from the main solenoid valve 32 and the pilot solenoid valve 34 likewise at a starting time or at a warming-up time.

Figure 2:
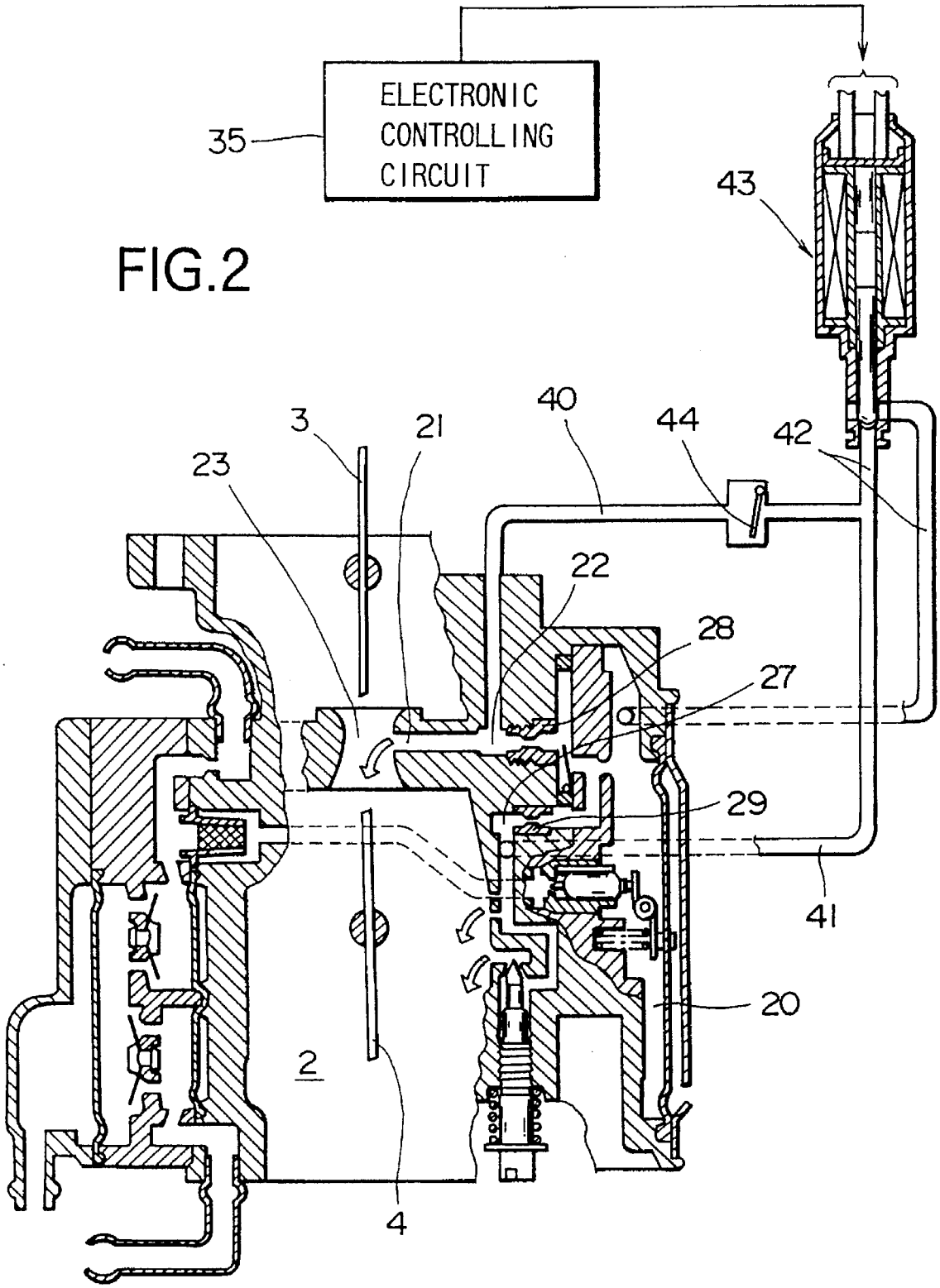
FIG. 2 is a sectional view which schematically shows the structure of an electronically controlled type floatless carburetor constructed in accordance with a second embodiment of the present invention.

Next, an electronically controlled type floatless carburetor constructed in accordance with a second embodiment of the present invention will be described below with reference to FIG. 2.

Same component in this embodiment as those in the first embodiment are represented by same reference numerals. In the first embodiment, two solenoid valves, i.e., the main solenoid valve 32 and the pilot solenoid valve 34 are used. In this embodiment, however, a single solenoid valve is used so as to control a quantity of main fuel and a quantity of slow system fuel.

The carburetor includes a main bypass passage 40 of which one end is communicated with a main fuel passage 22 on the downstream side of a main jet 28, and moreover, includes a pilot bypass passage 41 of which one end is communicated with a pilot fuel passage 27 on the downstream side of a pilot jet 29. The other end of the main bypass passage 40 and the other end of the pilot bypass passage 41 are united with each other to form a fuel introduction passage 42, and the opposite end relative to the united end of the fuel introduction passage 42 is communicated with a fuel regulating chamber 20. A solenoid valve 43 for adjusting a quantity of fuel passing therethrough is disposed at the intermediate position of the fuel introduction passage 42. In other words, the fuel delivered from the fuel regulating chamber 20 flows through the fuel introduction passage 42 to reach the solenoid valve 43 at which a quantity of fuel is adjusted. One part of the thus adjusted fuel is fed to the downstream side of the main jet 28, and the other part of the same is fed to the downstream side of the pilot jet 29.

With this construction, when the solenoid valve 43 is actuated, a quantity of fuel ejected to a Venturi Portion 23 of a suction passage 2 is such that a quantity of fuel passing through the main jet 28 serving as a fixed jet and a quantity of fuel to be fed to a main bypass passage 40 among the quantity of fuel measured by the solenoid valve 43 are summed up. On the other hand, when the solenoid valve 43 is actuated, a quantity of fuel ejected to the suction passage 2 via a slow system ejection port is such that a quantity of fuel passing through the pilot jet 29 serving as a fixed jet and a quantity of fuel fed to the pilot bypass jet passage 41 among the quantity of fuel measured by the solenoid valve 43 serving as a variable jet are summed up.

A check valve 44 is disposed at the intermediate position of the main bypass passage 40 so as to permit fuel to flow a fuel introduction passage 42 toward the main fuel passage 22 but prevent fuel from flowing back from the main fuel passage 22 toward the fuel introduction passage 22.

In the second embodiment, in the operational range where slow system fuel largely contributes to operation of the engine, a few quantity of fuel is ejected to the suction passage 2 from a main nozzle 21, and very few quantity of fuel is fed to the main bypass passage, even though fuel can flow from the main bypass passage 40 to the main fuel passage 22. Specifically, in the operational range where slow system fuel largely contributes to operation of the engine, almost of the fuel conducted to a branch point between the main bypass passage 40 and the pilot bypass passage 41 is fed to the pilot fuel passage 27 via the pilot bypass passage 41.

On the contrary, in the operational range where main fuel largely contributes to operation of the engine, a few quantity of fuel is ejected to the suction passage 2 through the slow system port, and very few quantity of fuel is fed to the pilot bypass passage 41, even though fuel can flow from the pilot bypass passage 41 to the pilot fuel passage 27. Specifically, in the operational range where main fuel largely contributes to operation of the engine, almost of fuel conducted to the branch point between the main bypass passage 40 and the pilot bypass passage 41 is fed to the main fuel passage 22 via the main bypass passage 40.

Therefore, not only in the operational range where slow system fuel largely contributed to operation of the engine but also in the operational range where main fuel largely contributed to operation of the engine, a substantially adequate air fuel ratio can be obtained by using a single solenoid valve 43. Consequently, excellent properties of operation can be maintained over the whole operational range of the engine at all times.

According to the present invention, in the case that the atmospheric pressure is taken as a parameter, the air fuel ratio can automatically be optimized by variably controlling the ejection of auxiliary fuel from the main solenoid valve 32 and the pilot solenoid valve 34 in response to variation of the atmospheric pressure. In addition, in the case that throttle valve opening extent, suction passage negative pressure and engine coolant temperature are taken as parameters, stable engine speed can be obtained at a starting tome or at a warming-up time by variably controlling the ejection of auxiliary fuel from the main solenoid valve 32 and the pilot solenoid valve 34 likewise at a starting time or at a worming-up time.

Provided that the check valve 44 is not disposed, in the operative range where slow system fuel largely contributes to operation of the engine, there arises a malfunction of back bleed that air from the suction passage 2 invades in the pilot fuel passage 27 from the main nozzle 21 via the main bypass passage 40. Owing to the presence of the check valve 44, in the operational range where slow system fuel largely contributes to operation of the engine, an adequate air fuel ratio can be maintained without an occurrence of back bleed.

Figure 3:
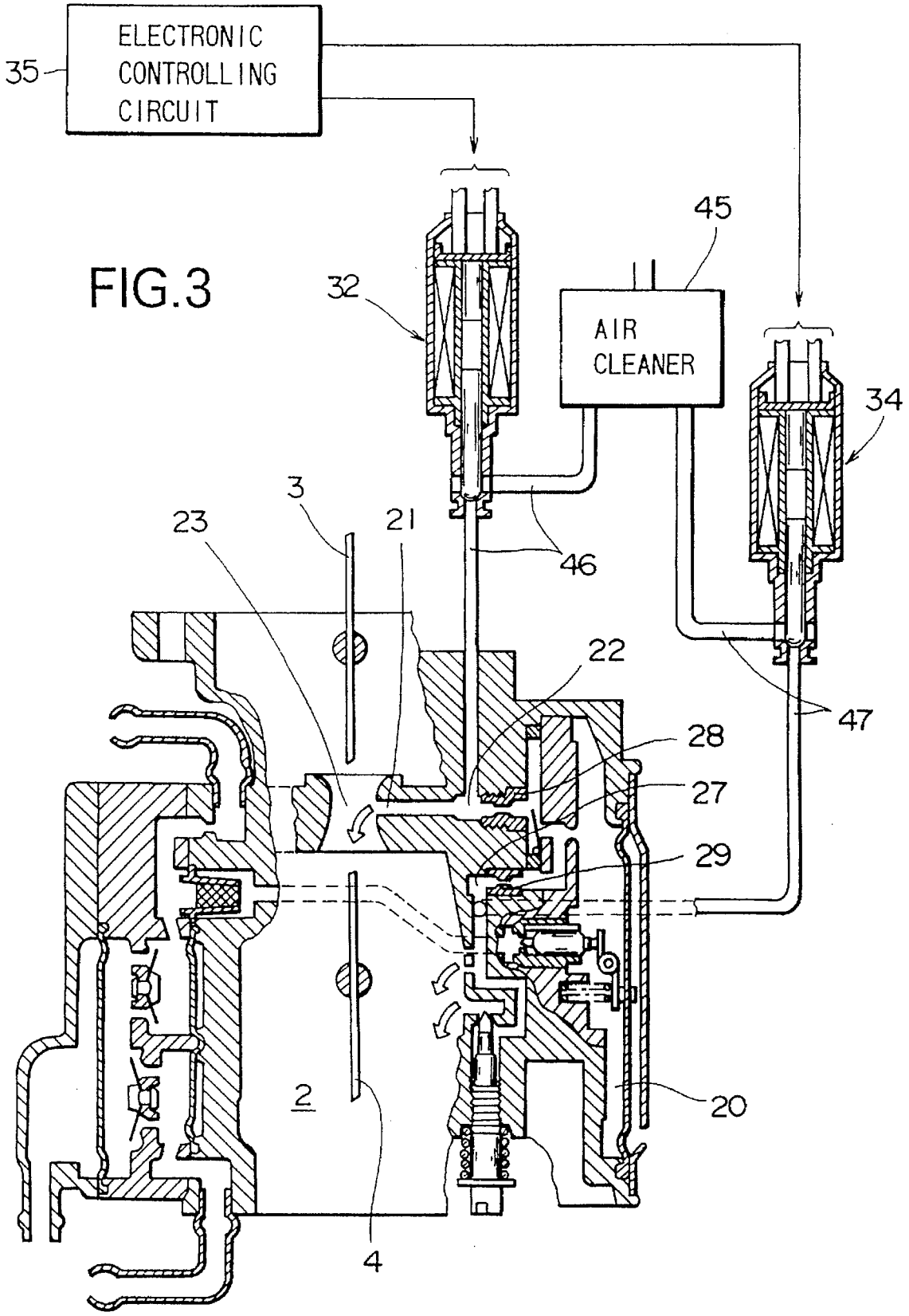
FIG. 3 is a sectional view which schematically shows the structure of an electronically controlled type floatless carburetor constructed in accordance with a third embodiment of the present invention.

Next, an electronically controlled type floatless carburetor constructed in accordance with a third embodiment of the present invention will be described below with reference to FIG. 3.

Same components in this embodiment as those in the first embodiment are represented by same reference numerals. In the first embodiment, a quantity of fuel to be fed to the main fuel passage 22 and the pilot fuel passage 27 is controlled by the main solenoid valve 32 and the pilot solenoid valve 34. However, in the third embodiment, air is introduced into a main fuel passage 22 and a pilot fuel passage 27, and a quantity of introduction of the air is controlled by a main solenoid valve 32 and a pilot solenoid valve 34.

The carburetor includes a main air passage 46 of which one end is communicated with an air cleaner 45 and of which other end is communicated with the downstream side of a main jet 28 in the main fuel passage 22. A main solenoid valve 32 is disposed at the intermediate position of the main air passage 46 so as to adjust a quantity of air passing through the main air passage 46. It is acceptable that the main air passage 46 is exposed directly to the atmosphere without any communication with the air cleaner 45.

In addition, the carburetor includes a pilot air passage 47 of which one end is communicated with the air cleaner 45 and of which other end is communicated with the downstream side of a pilot jet 29 in the pilot fuel passage 27. A pilot solenoid valve 34 for adjusting a quantity of air passing therethrough is disposed at the intermediate position of the pilot air passage 47. It is acceptable that the pilot air passage 47 is exposed directly to the atmosphere without any communication with the air cleaner 45.

When the main solenoid valve 32 is actuated, air is fed to the downstream side of a main jet 28 of the main fuel passage 22 via the main air supply passage 46. Consequently, fuel is fed by the main jet 28 serving as a fixed jet, and air is fed via the main solenoid valve 32, whereby a combination of the quantity of fuel with the quantity of air is ejected from a main nozzle 21.

When the pilot solenoid valve 34 is actuated, air is fed to the downstream side of the pilot jet 29 in the pilot fuel passage 27 via the pilot air passage 47. Consequently, fuel is fed by the pilot jet 29 serving as a fixed jet, and air is fed via the pilot solenoid valve 34 serving as a variable jet, whereby a combination of the quantity of fuel with the quantity of air is ejected to the suction passage 2 through the slow system ejection port.

As described above, in the third embodiment, a quantity of main fuel can be optimized by introducing air into the main fuel passage 22 by the main solenoid valve 32 and then controlling a quantity of introduction of the air. In addition, a quantity of fuel to be ejected through the slow system ejection port can be optimized by introducing air into the pilot fuel passage 27 by the pilot solenoid valve 34, and moreover, controlling a quantity of introduction of the air. To assure that the engine is stably driven, e.g., during a period of time from engine start to full warming-up, a driving duty width of the pilot solenoid valve 34 is narrowed to increase the air fuel ratio, and subsequently, at a full warming-up time, the driving duty width is widened to increase a quantity of air introduction to thereby obtain an adequate air fuel ratio.

In such a manner, in the third embodiment, an adequate air fuel ratio can be obtained over the whole operational range of the engine by controlling a quantity of air to be introduced into the fuel passage in consideration of surplus and shortage of a quantity of fuel conventionally arisen in a specific operational range of the engine, whereby excellent properties of operation can be maintained at all times.

This embodiment has been described above with respect to the case that the main solenoid valve 32 and the pilot solenoid valve 34 are simultaneously used to obtain an adequate air fuel ratio. However, in the case that the range requiring that the air fuel ratio is optimized is associated with main fuel, it is acceptable that only the main solenoid valve 32 is used while the pilot solenoid valve 34 is not used. On the contrary, in the case that the range requiring that the air fuel ratio is optimized is associated with pilot fuel, it is also acceptable that only the pilot solenoid valve 34 is used while the main solenoid valve 32 is not used.

According to the present invention, in the case that the atmospheric pressure is taken as a parameter, the air fuel ratio can automatically be optimized by variably controlling the ejection of auxiliary fuel from the main solenoid valve 32 and the pilot solenoid valve 34 in response to variation of the atmospheric pressure. In addition, in the case that throttle valve opening extent, suction passage negative pressure and engine coolant temperature are taken as parameters, stable engine speed can be obtained at a starting time or a warming-up time by variably controlling the ejection of auxiliary fuel from the main solenoid valve 32 and the pilot solenoid valve 34 likewise at a starting time or a warming-up time.

Figure 4:
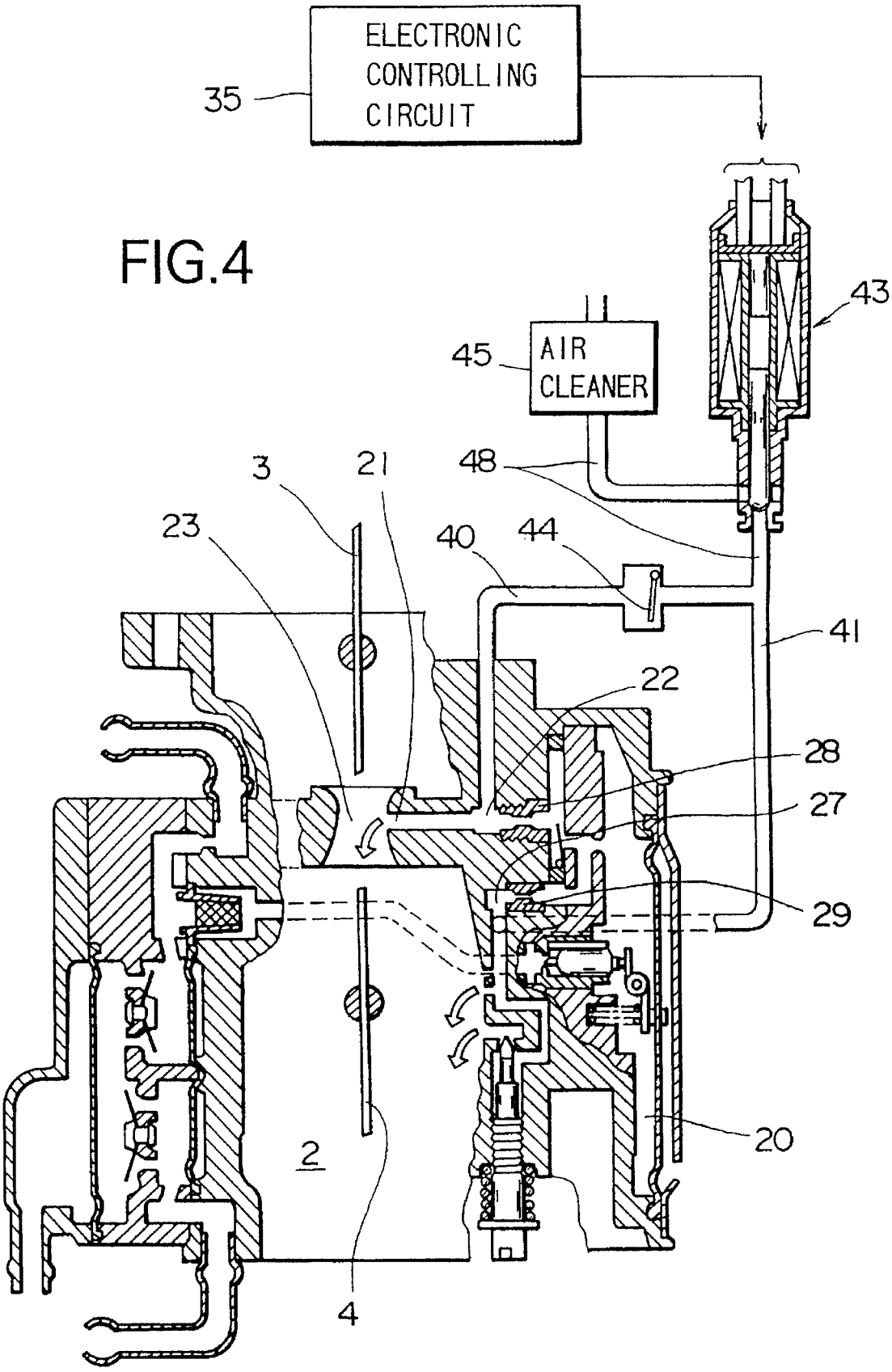
FIG. 4 is a sectional view which schematically shows the structure of an electronically controlled type floatless carburetor constructed in accordance with a fourth embodiment of the present invention.

Next, an electronically controlled type floatless carburetor constructed in accordance with a fourth embodiment of the present invention will be described below with reference to FIG. 4.

Same components in this embodiment as those in the first embodiment to the third embodiment are represented by same reference numerals. In the third embodiment, the main solenoid valve 32 is used to introduce air into the main fuel passage 22, and the pilot solenoid valve 34 is used to introduce air into the pilot fuel passage 27 so that two solenoid valves in total are used for the carburetor. In the fourth embodiment, however, a single solenoid valve is used to introduce air into a main fuel passage 22 and a pilot fuel passage 27.

The carburetor includes a main bypass passage 40 of which one end is communicated with the main fuel passage 22 on the downstream side of a main jet 28, and moreover, includes a pilot bypass passage 41 of which one end is communicated with the pilot bypass passage 27 on the downstream side of a pilot jet 29. The other end of the main bypass passage 40 and the other end of the pilot bypass passage 41 are united with each other to form an air introduction passage 48 of which other end is communicated with an air cleaner 45 or exposed to the atmosphere. A solenoid valve 43 is disposed at the intermediate position of the air introduction passage 48 to adjust a quantity of air passing therethrough. When the solenoid valve 43 is actuated, one part of the air of which quantity is adjusted by the solenoid valve 42 is fed to the downstream side of a main jet 28 in the main fuel passage 22 and the other part of the same is fed to the downstream side of a pilot jet 29 on the pilot fuel passage 27.

A check valve 44 is disposed at the intermediate position of the main bypass passage 40 so as to prevent back flow of air from the main fuel passage 22 side toward the pilot bypass passage 41.

In the fourth embodiment, in the operative range where slow system fuel largely contributes to operation of the engine, a small quantity of fluid is ejected from a main nozzle 21 to a suction passage 2, and very few quantity of air is introduced into the main bypass passage 40, even though air can flow from the main bypass passage 40 to the main fuel passage 22. Namely, in the operative range where slow system fuel largely contributed to operation of the engine, almost of a quantity of air conducted to a branch point between the main bypass passage 40 and the pilot bypass passage 41 is introduced into the pilot fuel passage 27 via the pilot bypass passage 41.

On the contrary, in the operative range where main fuel largely contributes to operation of the engine, a small quantity of mixture of fuel and air is ejected from the slow system ejection port even though air can flow from the pilot bypass passage 41 to the pilot fuel passage 27, whereby very small quantity of air is fed to the pilot bypass passage 41. Namely, in the operative range where main fuel largely contributes operation of the engine, almost of air conducted to the ranch point between the main bypass passage 40 and the pilot bypass passage 41 is introduced into the main fuel passage 22 via the main bypass passage 40.

Therefore, not only in the operative range where slow system fuel largely contributes to operation of the engine but also in the range where main fuel largely contributes to operation of the engine, a substantially adequate air fuel ratio can be obtained by using a single solenoid valve 43. Consequently, excellent properties of operation can be maintained over the whole operational range of the engine.

According to the present invention, in the case that the atmospheric pressure is taken as a parameter, the air fuel ratio can automatically be optimized by variably controlling the ejection of auxiliary fuel from the main solenoid valve 32 and the pilot solenoid valve 34. In addition, in the case that throttle valve opening extent, suction passage negative pressure and engine coolant temperature are taken as parameters, stable engine speed can be obtained at a starting time or at a warming-up time by variably controlling the ejection of auxiliary fuel from the main solenoid valve 32 and the pilot solenoid valve 34 likewise at a starting time or at a warming-up time.

Next, an electronically controlled type floatless carburetor constructed in accordance with a fifth embodiment of the present invention will be described below with reference to FIG. 5 and FIG. 6.

Same components in this embodiment as those in the first embodiment and the second embodiment are represented by same reference numerals. In the second embodiment, an air fuel ratio is controlled by using a single solenoid valve 43, and also in the fifth embodiment, the air fuel ratio is controlled by likewise using a single solenoid valve 43.

Figure 5:
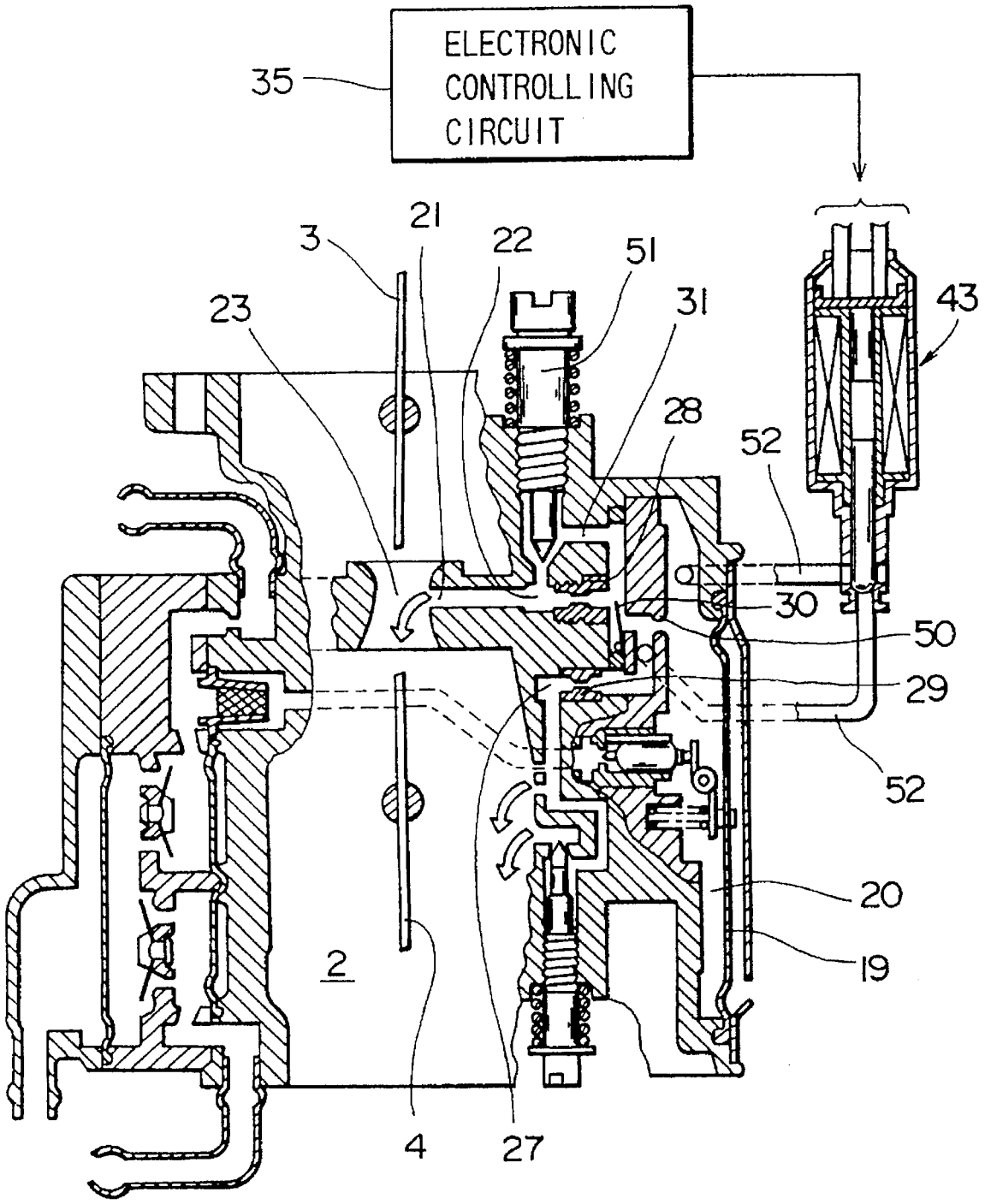
FIG. 5 is a sectional view which schematically shows the structure of an electronically controlled type floatless carburetor constructed in accordance with a fifth embodiment of the present invention.
Figure 6:
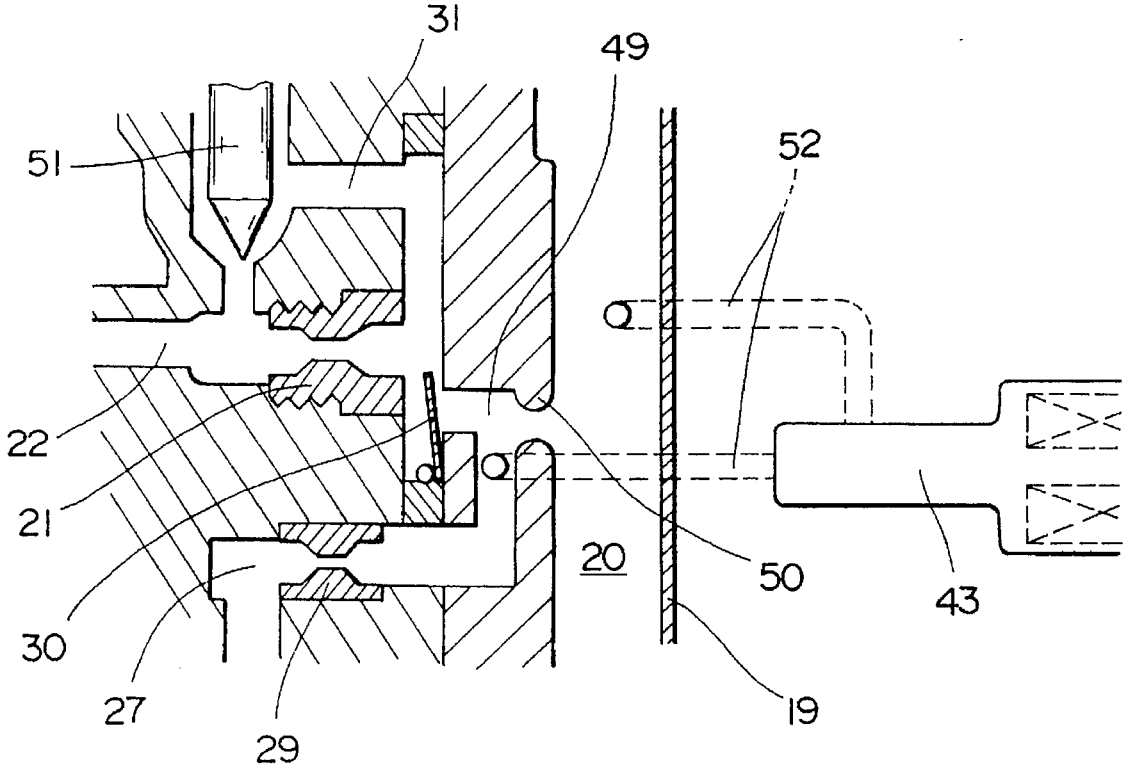
FIG. 6 is a fragmentary enlarged sectional view which shows an essential part of the carburetor shown in FIG. 5.

As shown in FIG. 5 and FIG. 6, the carburetor includes a united fuel passage 49 at which one end of a main fuel passage 22 having a main jet 28 formed at the intermediate position thereof and one end of a pilot fuel passage 27 having a pilot jet 29 formed at the intermediate position thereof are united with each other. The united fuel passage 49 is communicated with a fuel regulating chamber 20 via a throttle 50. A check valve 30 is disposed at the position located in the vicinity of the united fuel passage 49 extending from a main fuel passage 22. The main fuel passage 22 includes a main bypass passage 31 by way of which the upstream side of a main jet 28 and the downstream side of the same are communicated with each other. A main bypass screw 51 is disposed at the intermediate position of the main bypass passage 31 so as to adjust a cross-sectional area of the latter.

The fuel regulating chamber 20 and the united fuel passage 49 are communicated with each other via an auxiliary fuel feeding passage 52 extending therebetween. A solenoid valve 43 is disposed at the intermediate position of the auxiliary fuel feeding passage 52 so as to open and close of the latter. When the solenoid valve 43 is actuated, fuel from the fuel regulating chamber 20 is introduced into the auxiliary fuel feeding passage 52. Consequently, a quantity of fuel fed to the auxiliary fuel passage 49 is such that a quantity of fuel introduced via the throttle 51 and a quantity of fuel adjusted by the solenoid valve 43 and introduced via the auxiliary fuel feeding path 52 are summed up. Thereafter, the summed quantity of fuel is distributively fed to the main fuel passage 22 and the pilot fuel passage 27.

In the fifth embodiment, in the operative range where slow system fuel largely contributed to operation of the engine, a small quantity of fuel is ejected from the main nozzle 21, and very few quantity of fuel is fed to the united fuel passage 49, even though fuel can flow from the united fuel passage 49 to the main fuel passage 20. Namely, in the operative range where slow system fuel largely contributes to operation of the engine, almost of fuel fed to the united fuel passage 49 is fed to the pilot fuel passage 27.

On the contrary, in the operative range where main fuel largely contributes to operation of the engine, a small quantity of fuel is ejected through the slow system ejection port, and very few quantity of fuel is fed to the united fuel passage 49, even though fuel can flow from the united fuel passage 49 to the pilot fuel passage 27. Namely, in the operative range where main fuel largely contributes to operation of the engine, almost of fuel fed to the united fuel passage 49 by actuation of the solenoid valve 43 is fed to the main fuel passage 22.

Therefore, not only in the range where slow system fuel largely contributes to operation of the engine but also in the operative range where main fuel largely contributes to operation of the engine, substantially adequate air fuel ratio can be obtained by using a single solenoid valve 43. Thus, excellent properties of operation can be maintained over the whole operational range of the engine at all times.

According to the present invention, in the case that the atmospheric pressure is taken an a parameter, the air fuel ratio can automatically be optimized by variably controlling auxiliary fuel from the solenoid valve 43 in response to variation of the atmospheric pressure. Further, in the case that throttle valve opening extent, suction passage negative pressure and engine coolant temperature are taken as parameters, stable engine speed can be obtained at a starting time or a warming-up time by variably controlling the auxiliary fuel from the solenoid valve likewise at a starting time or at a warming-up time.

Figure 7:
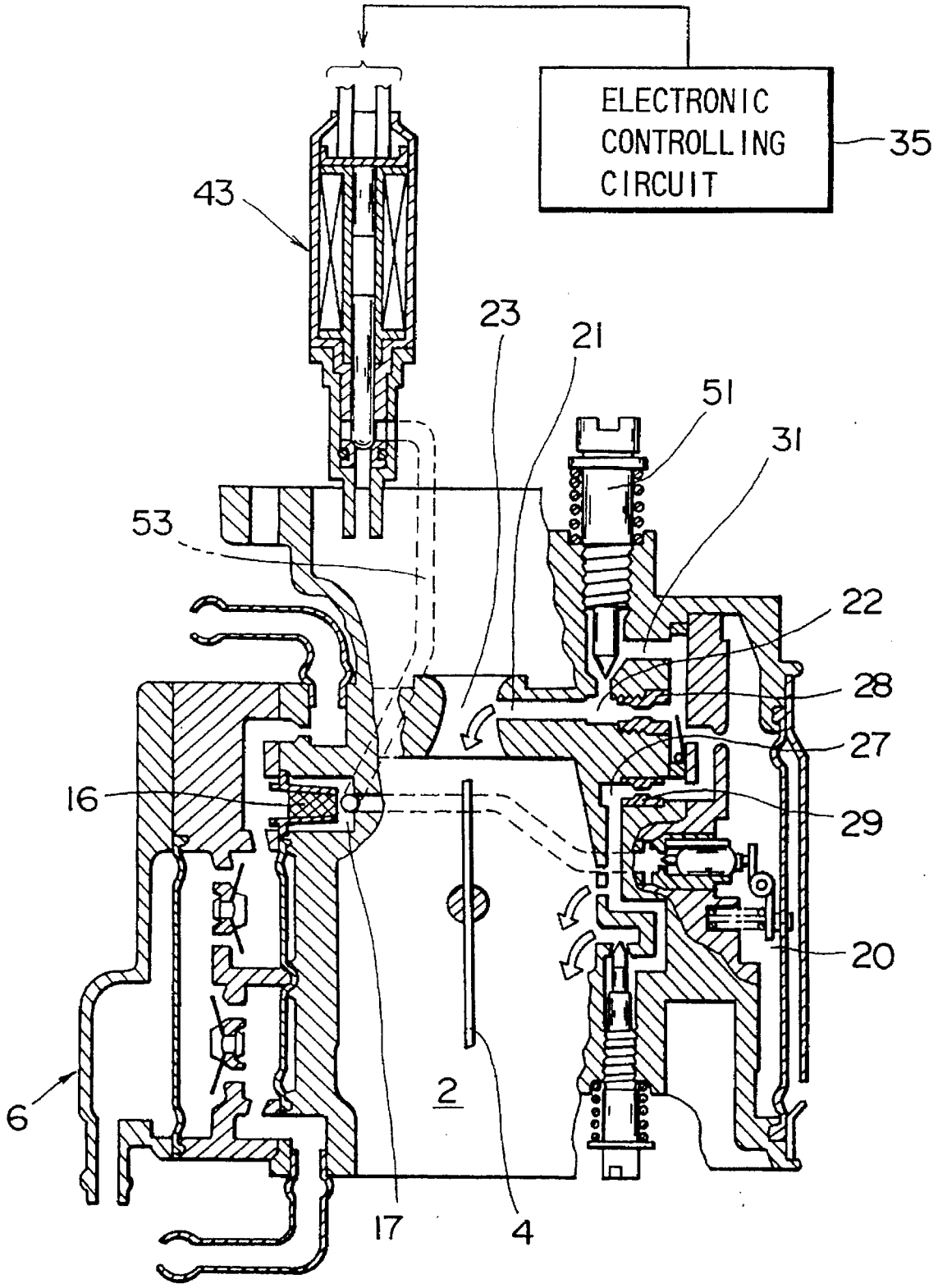
FIG. 7 is a sectional view which schematically shows the structure of an electronically controlled type floatless carburetor constructed in accordance with a sixth embodiment of the present invention.

Next, an electronically controlled type floatless carburetor constructed in accordance with a sixth embodiment of the present invention will be described below with reference to FIG. 7.

Same components in this embodiment as those in the first embodiment, the second embodiment and the fifth embodiment are represented by same reference numerals. In the second embodiment, the air fuel ratio is controlled by using a single solenoid valve 43. Also in the sixth embodiment, the air fuel ratio is controlled by using a single solenoid valve 43.

The solenoid valve 43 is disposed in a suction path 2 so as to enable fuel to be ejected directly upstream from a throttle valve 4. Fuel ejected by a pumping unit 6 is introduced into a starting well 17. Since the starting well 17 is communicated with the solenoid valve 43 via a fuel introduction passage 53, a part of the fuel passing through, the starting well 17 is introduced into the solenoid valve 43.

In this embodiment, since the auxiliary fuel of which quantity is adjusted by the solenoid valve 43 can be ejected directly also in the case that there is shortage in quantity of fuel, adequate air fuel ratio can be obtained. Thus, excellent properties of operation can be maintained over the whole operational range of the engine at all times.

Further, in this embodiment, since a large quantity of fuel necessary at a starting time or at a warming-up time is ejected directly in the suction passage 2 from the solenoid valve 43, a choke valve serving to eject a large quantity of fuel at a starting time or a warming-up time of the conventional carburetor can be obviated.

According to the present invention, in the case that the atmospheric pressure is taken as a parameter, the air fuel ratio can be optimized by variably changing auxiliary fuel from the solenoid valve 43 in response to variation of the atmospheric pressure. Further, in the case that throttle valve opening extent, suction passage negative pressure and engine coolant temperature are taken as parameters, stable engine speed can be obtained at a starting time or at a warming-up time by variably controlling auxiliary fuel from the solenoid valve 43 likewise at a starting time or at a warming-up time.

Figure 8:
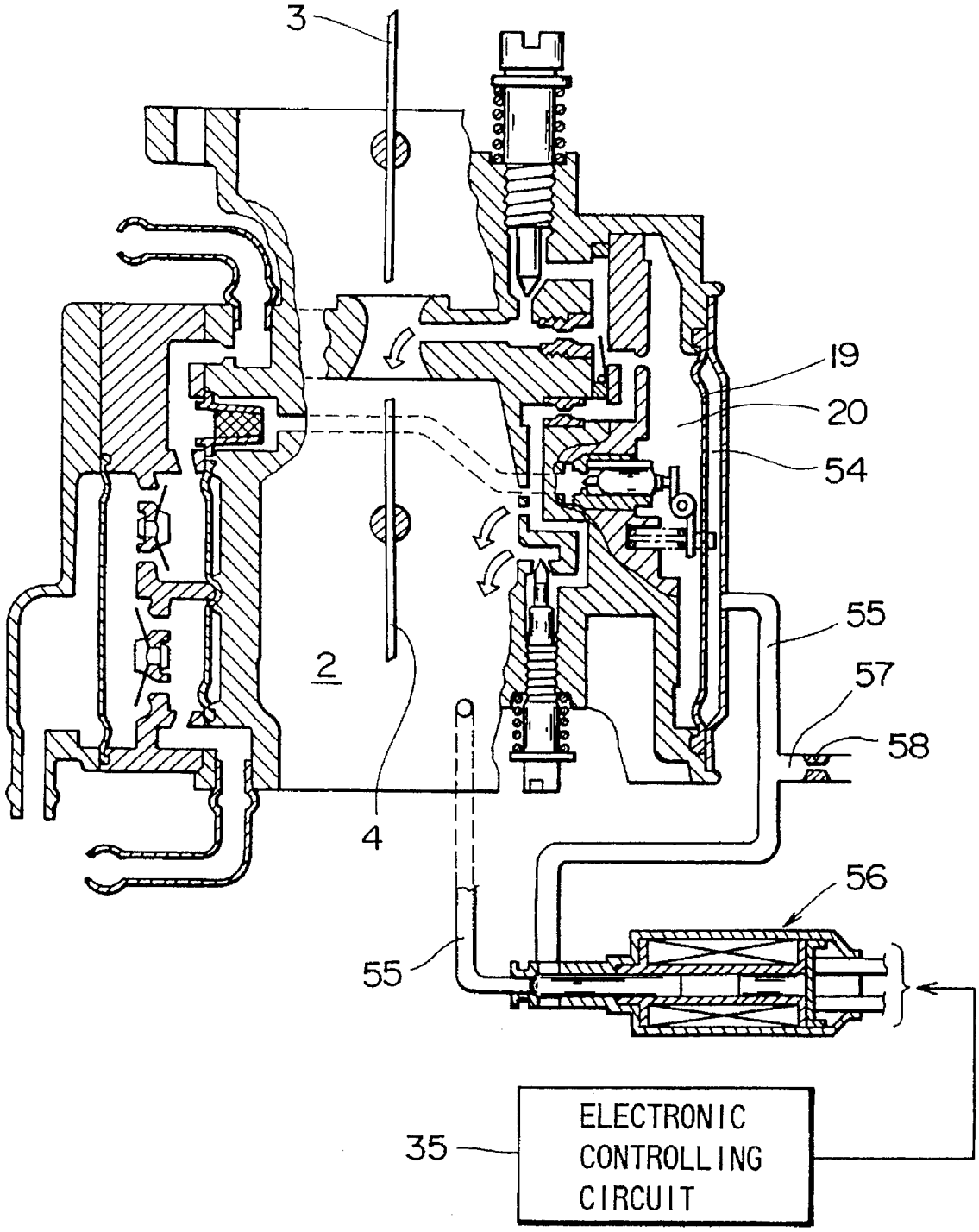
FIG. 8 is sectional view which schematically shows the structure of an electronically controlled type floatless carburetor constructed in accordance with a seventh embodiment of the present invention.

Next, an electronically controlled type floatless carburetor constructed in accordance with a seventh embodiment of the present invention will be described below with reference to FIG. 8.

Same components in this embodiment as those in the first embodiment, the second embodiment and the fifth embodiment are represented by same reference numerals. In the first embodiment to the sixth embodiment, the air fuel ratio is controlled by feeding auxiliary fuel or air to the main fuel passage 22 or the pilot fuel passage 27. In the seventh embodiment, however, the air fuel ratio is controlled by actuation of a main diaphragm 19.

The carburetor includes a negative pressure introduction chamber 54 on the opposite side to a fuel regulating chamber 20 with the diaphragm 19 disposed therebetween, and the negative pressure chamber 54 and the position located downstream of a throttle valve 4 are communicated with each other via a negative pressure introduction passage 55 extending therebetween. A solenoid valve 56 is disposed at the intermediate position of the negative pressure introduction passage 55 so as to adjust a quantity of introduction of negative pressure passing therethrough. The negative pressure introduction passage 55 is communicated with an atmosphere passage 57 on the side located nearer to the negative pressure introduction chamber 54 than the position where the solenoid valve 56 is disposed, and a throttle 58 is disposed at the intermediate position of the atmosphere passage 57.

With such construction, in the case that the solenoid valve 56 is not actuated, atmospheric pressure is introduced into the negative pressure introduction chamber 54 via the throttle 58 but the suction passage negative pressure is not introduced into the negative pressure introduction chamber 54. On the contrary, in the case that the solenoid valve 56 is actuated, the suction passage negative pressure controlled by the solenoid valve 56 is introduced into the negative pressure introduction chamber 54.

When the quantity of introduction of the negative pressure into the negative pressure introduction chamber 54 receives duty control by the solenoid valve 56, it becomes possible to more finely adjust a quantity of fuel to be fed from the fuel regulating chamber 20 to the main fuel passage 22 and the pilot fuel passage 27 by actuating the diaphragm 19.

Consequently, the air fuel ratio can more adequately be controlled over the whole operational range of the engine.

According to the present invention, in the case that the atmospheric pressure is taken as a parameter, the air fuel ratio can automatically be optimized by variably controlling auxiliary fuel from the solenoid valve 56 in response to variation of the atmospheric pressure. Further, in the case that throttle valve opening extent, suction passage negative pressure and engine coolant temperature are taken as parameters, stable engine speed can be obtained at a starting time or warming-up time by variably controlling auxiliary fuel from the solenoid valve 56 likewise at a starting time or at a warming-up time.

While the present invention has been described above with respect to several preferred embodiments thereof, it should of course be understood that the present invention should not be limited only to these embodiments but various change or modification may be made without departure from the scope of the present invention as defined by the appended claims.

What is claimed is:

1. A electronically controlled type floatless carburetor wherein fuel is delivered to a fuel regulating chamber by actuation of pumping means, the fuel from said fuel regulating chamber is ejected in a suction passage from a main nozzle via a main fuel passage including a main jet, and moreover, the fuel from said fuel regulating chamber is ejected in said suction passage from a slow system ejection port via a pilot fuel passage including a pilot jet, comprising:

a main bypass passage having a first and a second end, the first end of the main bypass passage being communicated with the main fuel passage at a position located downstream of the main jet, and the second end of the main bypass passage being communicated at a position located upstream of the main jet;

a check valve disposed upstream of the main jet in the main fuel passage to prevent the backflow of air from the suction passage through the main fuel passage and the main bypass passage to the fuel regulating chamber and the pilot fuel passage;

a main solenoid valve disposed at the intermediate position of said main bypass passage to adjust a quantity of fuel passing through said main bypass passage by duty driving; and an electronic controlling circuit for controlling actuation of said main solenoid valve in response to inputting of one or more parameters, wherein the quantity of fuel ejected in said suction passage from said main nozzle includes a quantity of fuel adjusted by duty driving while passing through said main bypass passage as said main solenoid valve is actuated and a quantity of fuel passing through said main jet.

2. The electronically controlled type floatless carburetor as claimed in claim 1, wherein said main solenoid valve is actuated in conformity with a period synchronized with an engine speed.

3. The electronically controlled type floatless carburetor as claimed in claim 1, wherein said main solenoid valve is normally actuated in conformity with a fixed period, and when an engine is driven at a specific engine speed, said fixed period is slightly elongated or shortened.

4. An electronically controlled type floatless carburetor wherein fuel is delivered to a fuel regulating chamber by actuation of pumping means, the fuel from said fuel regulating chamber is ejected in a suction passage from a main nozzle via a main fuel passage including a main, jet and moreover, the fuel from said fuel regulating chamber is ejected in said suction passage from a slow system ejection port via a pilot fuel passage including a pilot jet, comprising:

a pilot bypass passage by way of which a position located on the upstream side of said pilot jet is communicated with a position located on the downstream side of the same;

a pilot solenoid valve disposed at the intermediate position of said pilot bypass passage to adjust a quantity of fuel passing through said pilot bypass passage by duty driving; and an electronic controlling circuit for controlling actuation of said pilot solenoid valve in response to inputting of one or more parameters, wherein the quantity of fuel ejected in said suction passage from the slow system ejection port includes a quantity of fuel adjusted by duty driving while passing through said pilot bypass passage as said pilot solenoid valve is actuated and a quantity of fuel passing through said pilot jet.

5. The electronically controlled type floatless carburetor as claimed in claim 4, wherein said pilot solenoid valve is actuated in conformity with a period synchronized with an engine speed.

6. The electronically controlled type floatless carburetor as claimed in claim 4, wherein said pilot solenoid valve is normally actuated in conformity with a fixed period, and when and engine is driven at a specific engine speed, said fixed period is slightly elongated or shortened.

7. An electronically controlled type floatless carburetor wherein fuel is delivered to a fuel regulating chamber by actuation of pumping means, the fuel from said fuel regulating chamber is ejected in a suction passage from a main nozzle via a main fuel passage including a main jet, and moreover, the fuel from said fuel regulating chamber is ejected in said suction passage from a slow system ejection port via a pilot fuel passage including a pilot jet, comprising:

a main bypass passage of which one end is communicated with said main fuel passage located downstream of said main jet;

a pilot bypass passage of which one end is communicated with said pilot fuel passage located downstream of said pilot jet, the other end of said main bypass passage and the other end of said pilot bypass passage being united with each other to form a fuel introduction passage which is communicated with said fuel regulating chamber so as to bypass said main and pilot jets;

a solenoid valve disposed at the intermediate position of said fuel introduction passage to adjust a quantity of fuel passing through said fuel introduction passage by duty driving; and an electronic controlling circuit for controlling actuation of said solenoid valve in response to inputting of one or more parameters, wherein the quantity of fuel ejected in said suction passage from said main nozzle includes a quantity of fuel adjusted by duty driving while passing through said main bypass passage as said solenoid valve is actuated and a quantity of fuel passing through said main jet and moreover, the quantity of fuel ejected in said suction passage through said slow system ejection port includes a quantity of fuel adjusted by duty driving while passing through said pilot bypass passage and a quantity of fuel passing through said pilot jet.

8. The electronically controlled type floatless carburetor as claimed in claim 7, wherein said solenoid valve is actuated in conformity with a period synchronized with an engine speed.

9. The electronically controlled type floatless carburetor as claimed in claim 7, wherein said solenoid valve is normally actuated in conformity with a fixed period, and when an engine is driven at a specific engine speed, said fixed period is slightly elongated or shortened.

10. The electronically controlled type floatless carburetor as claimed in claim 7, wherein a check valve is disposed at the intermediate position of said main bypass passage so as to prevent fluid from flowing from said main fuel passage to said fuel introduction passage via said main bypass passage.

11. An electronically controlled type floatless carburetor wherein fuel is delivered to a fuel regulating chamber by actuation of pumping means, the fuel from said fuel regulating chamber is ejected in a suction passage from a main nozzle via a main fuel passage including a main jet, and moreover, the fuel from said fuel regulating chamber is ejected in said suction passage from a slow system ejection port via a pilot fuel passage including a pilot jet, comprising:

a main bypass passage by way of which a position located on the upstream side of said main jet of said main fuel passage is communicated with a position located on the downstream side of the same;

a main solenoid valve disposed at the intermediate position of said main bypass passage to adjust a quantity of fuel passing through said main bypass passage by duty driving;

a pilot bypass passage by way of which a position located on the upstream side of said pilot jet is communicated with a position located on the downstream side of the same;

a pilot solenoid valve disposed at the intermediate position of said pilot bypass passage to adjust a quantity of fuel passing through said pilot bypass passage by duty driving; and an electronic controlling circuit for controlling actuation of said main solenoid valve and said pilot solenoid valve in response to inputting of one or more parameters, wherein the quantity of fuel ejected in said suction passage from said main nozzle includes a quantity of fuel adjusted by duty driving while passing through said main bypass passage as said main solenoid valve is actuated and a quantity of fuel passing through said main jet, and wherein the quantity of fuel ejected in said suction passage from the slow system ejection port includes a quantity of fuel adjusted by duty driving while passing through said pilot bypass passage as said pilot solenoid valve is actuated and a quantity of fuel passing through said pilot jet.

12. The electronically controlled type floatless carburetor as claimed in claim 11, wherein said main solenoid valve is actuated in conformity with a period synchronized with an engine speed.

13. The electronically controlled type floatless carburetor as claimed in claim 11, wherein said main solenoid valve is normally actuated in conformity with a fixed period, and when an engine is driven at a specific engine speed, said fixed period is slightly elongated or shortened.

14. The electronically controlled type floatless carburetor as claimed in claim 11, wherein said pilot solenoid valve is actuated in conformity with a period synchronized with an engine speed.

15. The electronically controlled type floatless carburetor as claimed in claim 11, wherein said pilot solenoid valve is normally actuated in conformity with a fixed period, and when an engine is driven at a specific engine speed, said fixed period is slightly elongated or shortened.

* * * * *